US005925279A

United States Patent [19]

Baek

[11] Patent Number: 5,925,279

[45] Date of Patent: Jul. 20, 1999

[54] OPERATION CONTROL METHOD OF MICROWAVE OVEN

[75] Inventor: Jeong-Hyun Baek, Suwon, Rep. of Korea

[73] Assignee: Samsung Electronics Co., Ltd., Suwon-City, Rep. of Korea

[21] Appl. No.: 09/126,714

[22] Filed: Jul. 31, 1998

[30] Foreign Application Priority Data

Aug. 21, 1997 [KR] Rep. of Korea ..... 97-39978

[51] Int. Cl.[6] ..... H05B 6/68

[52] U.S. Cl. ..... 219/720; 219/702; 219/506; 219/719; 99/325

[58] Field of Search ..... 219/720, 719, 219/702, 506; 99/325

[56] References Cited

U.S. PATENT DOCUMENTS

| | | | |
|---|---|---|---|
| 4,162,381 | 7/1979 | Buck | 219/707 |
| 4,339,646 | 7/1982 | Doi et al. | 219/714 |
| 4,517,431 | 5/1985 | Ueda | 219/720 |
| 4,705,926 | 11/1987 | Sakai et al. | 219/703 |

*Primary Examiner*—Philip H. Leung
*Attorney, Agent, or Firm*—Burns, Doane, Swecker & Mathis, L.L.P.

[57] ABSTRACT

An operation control method of a microwave oven by which a completion preparation sound is generated before a cooking completion time to notify a user a cooking process state and a cooking completion is notified in advance to provide an allowance time for the user to prepare the cooking completion to the benefit thereto.

5 Claims, 2 Drawing Sheets

OPERATION CONTROL METHOD OF MICROWAVE OVEN

BACKGROUND OF THE INVENTION

1. Field of the Invention

The present invention relates to a microwave oven, and more particularly to an operation control method of a microwave oven constructed such that a cooking end preparation sound is generated before cooking end and cooking end sound is generated when cooking is finished to notify a user a cooking process and to allow the user to know the cooking completion in advance.

2. Description of the Prior Art

Generally, a microwave oven is constructed such that high voltage is generated from a high voltage transformer by a predetermined power source supplied from outside and microwaves are generated by a magnetron according to the high voltage to thereby heat and cook foodstuff in a cooking chamber.

In the microwave oven thus constructed, when a user inserts a foodstuff into a cooking chamber (not shown), sets up a cooking course (by way of example, cooking function, cooking time, etc.) through a key input unit (not shown) and inputs a cooking start, the key input unit outputs to a controller (not shown) an electrical key signal corresponding thereto.

Next, when the controller outputs a control signal to a magnetron driving unit (not shown) to drive a magnetron (not shown) according to the key signal, and when the magnetron driving unit drives the magnetron according to the control signal, microwaves are generated to heat and cook foodstuff in a cooking chamber.

When the controller drives the magnetron and counts a cooking time and when the counted time is a cooking completion time (to be more specific, when the cooking time established by a user is a cooking completion time), the controller outputs to the magnetron driving unit a control signal to stop the magnetron and simultaneously outputs a control signal to a buzzer (not shown) to generate a cooking completion sound.

Next, when the magnetron driving unit stops the magnetron according to the control signal, the magnetron is stopped, and, by which, microwaves are not generated to thereby stop cooking the foodstuff in the cooking chamber and the buzzer generates a completion sound according to the control signal to notify the user of the cooking completion and completes the overall cooking processes.

However, there is a problem in the conventional microwave oven thus constructed in that a cooking process sound is not generated during the cooking, and a cooking completion sound is generated after the cooking to notify the user only upon the cooking completion, so that the user cannot know the state of the cooking process nor is he given a time allowance for preparing the cooking completion (by way of example, when the user cooks, a preparation time for performing a next cooking process with the foodstuff cooked by the microwave oven is not given), thereby providing an inconvenience to the user.

SUMMARY OF THE INVENTION

The present invention is disclosed to solve the aforementioned problem and it is an object of the present invention to provide an operation control method of a microwave oven adapted to generate a completion preparation sound before the cooking completion and to generate a completion sound after the cooking is finished to thereby advise a user a cooking process and simultaneously provide a time allowance for preparing the cooking completion before the cooking is completed to the convenience of the user.

In accordance with the object of the present invention, there is provided an operation control method of a microwave oven, the method comprising the steps of:

driving a magnetron according to a cooking course input by a user and simultaneously counting a cooking time;

generating a completion preparation sound when the cooking time counted at the cooking time counting step is a cooking completion preparation time; and stopping the magnetron when the cooking time counted at the cooking time counted at the cooking time counting step is the cooking completion time and simultaneously generating a completion sound.

BRIEF DESCRIPTION OF THE DRAWINGS

For a fuller understanding of the nature and objects of the invention, reference should be made to the following detailed description taken in conjunction with the accompanying drawings in which.

DETAILED DESCRIPTION OF THE INVENTION

The operation control method of a microwave oven according to the present invention will now be described in detail with reference to the accompanying drawings.

Figure 1:
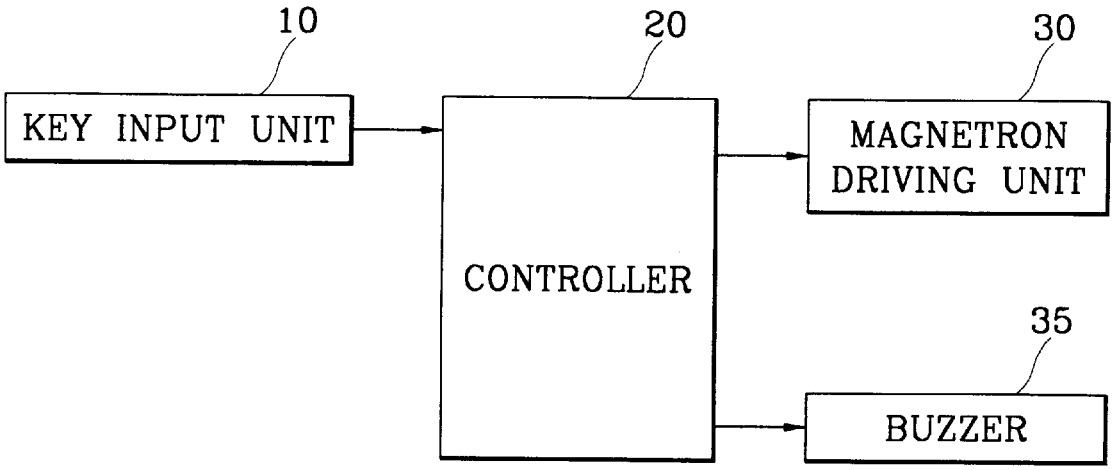
FIG. 1 is a block diagram for schematically illustrating a microwave oven for performing an operation control method according to the present invention.

As illustrated in FIG. 1, a microwave oven for performing an operation control method of a microwave oven according to the present invention includes a key input unit 10, a controller 20, a magnetron driving unit 30 and a buzzer 35.

The key input unit 10 outputs an electrical key signal corresponding to a cooking course (by way of example, cooking function, cooking time, etc.) when a user establishes and inputs the cooking course and is provided with a plurality of function keys such as a start key and the like for inputting a cooking start. The controller 20 outputs a control signal for driving a magnetron according to the key signal for driving a magnetron according to the key signal input from the key input unit 10 and simultaneously counts a cooking time.

Furthermore, the controller 20 discriminates whether the counted time is a cooking completion preparation time, and if it is discriminated as the cooking completion preparation time, the controller 20 outputs a control signal for generating a completion preparation sound and discriminates whether the counted time is a cooking completion time, and if it is discriminated as the cooking completion time, the controller 20 outputs a control signal for stopping the magnetron and simultaneously outputs a control signal for generating a completion sound.

The magnetron driving unit 30 drives or stops a magnetron according to a control signal from the controller 20 and the buzzer 35 generates a completion preparation sound or a completion sound according to a control from the controller 20.

Figure 2:
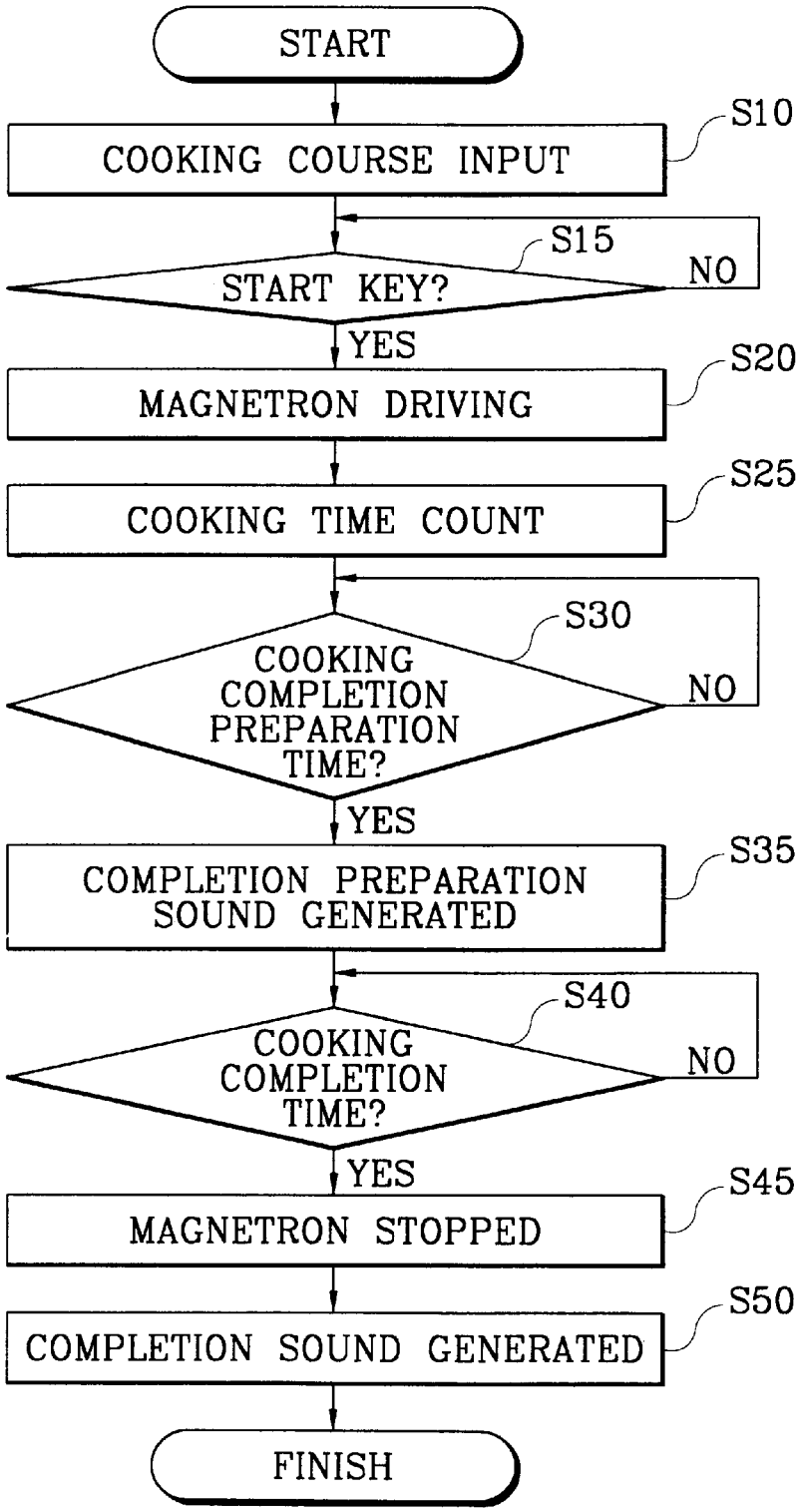
FIG. 2 is a flow chart for illustrating an operational procedures of operation control method according to the present invention.

Meanwhile, as illustrated in FIG. 2, the operation control method of a microwave oven according to the present invention comprises the steps of: setting up a cooking course by a user and inputting thereof (step S10); discriminating whether a start key is input (step S15); driving a magnetron according to the input cooking course (step S20); counting a cooking time (S25); discriminating whether the counted time is a cooking completion preparation time (step S30); generating a completion preparation sound (S35); discriminating whether the counted time is a cooking completion time (S40); stopping the magnetron (S45); and generating a completion sound (S50).

Now, the operation control method of a microwave oven according to the present invention thus constructed will be described in detail with FIGS. 1 and 2.

First of all, when a user inserts foodstuff into a cooking chamber, establishes a cooking course (by way of example, cooking function, cooking time, etc.) through the key input unit 10 and inputs a start key for starting the cooking, the key input unit 10 outputs an electrical key signal corresponding hereto to the controller 20, (step S10).

Next, when the controller 20 receives the key signal and discriminates whether the start key has been input and if it is discriminated that the start key has not been input, the controller 20 repeats the discrimination as to whether the start key has been input and if it is discriminated that the start key has been input, the controller 20 outputs to the magnetron driving unit 30 a control signal for driving the magnetron (step S15).

Successively, the magnetron driving unit 30 drives the magnetron according to the control signal, and according as the magnetron is driven, microwaves are generated to heat and cook the foodstuff in the cooking chamber (step S20).

The controller 20 drives the magnetron and simultaneously counts the cooking time, (step S25), and a discrimination is made as to whether the counted time is a cooking completion preparation time (step S30) (to be more specific, when the cooking time is established by a user, the cooking completion preparation time is automatically established, and is previously established as ten(10) seconds before the cooking time established by the user, so that, if the cooking time set up by the user is two(2) minutes, the cooking completion preparation time is established as one(1) minute fifty(50) second). If the counted time is discriminated as not being the cooking completion preparation time, the controller 20 drives the magnetron and repeats discrimination as to whether the counted cooking time is the cooking completion preparation time.

Successively, the controller 20 outputs a control signal to the buzzer for generating a completion preparation sound (by way of example, a gradually quickening sound at every one second interval for ten(10) seconds after which the cooking time is terminated from the previously established cooking completion preparation time, when the counted cooking time is discriminated as cooking completion preparation time as a result of discrimination at step S30. Thus, the buzzer 35 generates a completion preparation sound according to the control signal to advise the user of a cooking process status that it is on the is notified of the time that it is on the so that, he can be given an allowance time for preparing a cooking completion (step S35).

The controller 20 discriminates whether the counted time is the cooking completion time (to be more specific, the time during which the cooking time established by the user is completed), (step S40), and if it is discriminated that the counted time is not the cooking completion time, the controller 20 generates a completion preparation sound, and repeats discrimination as to whether the counted time is the cooking completion time.

Successively, the controller 20 outputs a control signal for stopping the magnetron to the magnetron driving unit 30 when t is discriminated that the counted time is cooking completion time as a result of discrimination at step S40, and concurrently outputs to the buzzer 35 a control signal for generating a completion sound (by way of example, a sound generated three(3) times at 0.5 second interval).

The magnetron driving unit 30 now stops the magnetron according to the control signal (step S45) and the buzzer 35 generates a completion sound according to the control signal to advise the user and to terminate the whole cooking operations of the microwave oven (step S50).

As is apparent from the foregoing, there is an advantage in the operation control method of a microwave oven according to the present invention, in that a completion preparation sound is generated before a cooking completion time to notify a user of a cooking process state and a cooking completion is notified in advance to provide an allowance time for the user to prepare the cooking completion to the benefit thereto.

What is claimed is:

1. An operation control method of a microwave oven having a magnetron, the method comprising the steps of:

A) inputting a cooking course for establishing a cooking completion time period;

B) automatically establishing a cooking preparation time period as a function of the cooking completion time period, the cooking preparation time period being less than the cooking completion time period;

C) driving the magnetron for the entire established cooking completion time period;

D) counting a cooking time period beginning with the driving of the magnetron;

E) generating a completion preparation sound when the cooking time period counted at step D equals the cooking completion preparation time period, while continuing to drive the magnetron; and F) stopping the magnetron when the cooking time period counted at step D equals the cooking completion time period, and simultaneously generating a completion sound.

2. A method according to claim 1, wherein the cooking preparation time period is automatically established as expiring about 10 seconds before the end of cooking completion time period.

3. A method according to claim 2, wherein the completion preparation sound constitutes a gradually quickening sound generated at time intervals until the end of the cooking completion time period.

4. A method according to claim 1, wherein the completion preparation sound comprises a gradually quickening sound generated repeatedly at time intervals until the end of the cooking completion time period.

5. A method according to claim 1, wherein step B comprises establishing a cooking preparation time period which expires nearer to the end of the cooking completion time period than to the beginning thereof.

* * * * *